United States Patent [19]

Imamura et al.

[11] Patent Number: 4,485,162

[45] Date of Patent: Nov. 27, 1984

[54] MAGNETIC CARRIER POWDER HAVING A WIDE CHARGEABLE RANGE OF ELECTRIC RESISTANCE USEFUL FOR MAGNETIC BRUSH DEVELOPMENT

[75] Inventors: Kenji Imamura; Hiroshi Saitoh; Katsuhisa Kakizaki; Motohiko Makino, all of Tokyo, Japan

[73] Assignee: TDK Electronics Co., Ltd., Tokyo, Japan

[21] Appl. No.: 464,929

[22] Filed: Feb. 8, 1983

[30] Foreign Application Priority Data

Feb. 12, 1982 [JP] Japan ..... 57-20963
Feb. 12, 1982 [JP] Japan ..... 57-20964
Feb. 12, 1982 [JP] Japan ..... 57-20965

[51] Int. Cl.[3] ..... G03G 9/14
[52] U.S. Cl. ..... 430/106.6; 430/122
[58] Field of Search ..... 430/106.6, 107, 109, 430/111, 137, 903, 904; 252/62.54

[56] References Cited

U.S. PATENT DOCUMENTS 3,627,682 12/1971 Hall ..... 430/106.6
3,839,029 10/1974 Berg et al. .
3,914,181 10/1975 Berg et al. .
3,929,657 12/1975 Jones .
4,042,518 8/1977 Jones .
4,282,302 8/1981 Makino et al. ..... 430/106.6

FOREIGN PATENT DOCUMENTS 293036 8/1971 Austria .
10732 5/1980 European Pat. Off. .
2320883 11/1973 Fed. Rep. of Germany .
751623 4/1957 United Kingdom .

*Primary Examiner*—John E. Kittle
*Assistant Examiner*—John L. Goodrow
*Attorney, Agent, or Firm*—Oblon, Fisher, Spivak, McClelland & Maier

[57] ABSTRACT

A magnetic carrier powder composed essentially of particles of a ferrite having a composition represented by the formula $$(MO)_{100-x}(Fe_2O_3)_x$$

where M is Mg, Mn, Zn, Ni, a combination of Mg in an atomic ratio of at least 0.05 with at least one metal selected from the group consisting of Zn, Cu, Mn and Co, a combination of Mn in an atomic ratio of at least 0.05 with at least one metal selected from the group consisting of Zn, Cu, Mg and Co, or a combination of Ni in an atomic ratio of at least 0.05 with at least one metal selected from the group consisting of Zn, Mg, Mn, Cu and Co, and x is greater than 53 molar %.

19 Claims, No Drawings

MAGNETIC CARRIER POWDER HAVING A WIDE CHARGEABLE RANGE OF ELECTRIC RESISTANCE USEFUL FOR MAGNETIC BRUSH DEVELOPMENT

The present invention relates to a magnetic carrier powder. More particularly, the present invention relates to a magnetic carrier powder to be used for magnetic brush development.

It has been proposed to use a so-called soft ferrite as a carrier powder for magnetic brush development (see, for instance, U.S. Pat. Nos. 3,839,029, 3,914,181 or 3,929,657).

A carrier powder composed of such a ferrite exhibits magnetic characteristics equal to a conventional iron powder carrier but is not require a coating layer such as a resin layer on its surface as is required for the iron powder carrier. Therefore, it is far superior in its durability.

The ferrite composition which is in use as a conventional carrier powder is represented by the formula $(MO)_{100-x}(Fe_2O_3)_x$ (where M is at least one of divalent metals), x is at most 53 molar %.

According to the results obtained by the research conducted by the present inventors, the electric resistance of ferrite powder particles can be varied by controlling the atmosphere for burning even when the ferrite powder particles have the same composition. By changing the resistance of the carrier powder, it is possible to obtain images having various gradations and to optionally control the image quality. Further, the resistance of the carrier powder can be changed to obtain the optimum characteristics for a variety of copying machines.

Accordingly, for the ferrite powder particles, the wider the range of electric resistance change by modification of burning atmosphere, the better.

However, the above-mentioned ferrite composition containing at most 53 molar % of $Fe_2O_3$ has a high resistance value by itself and the image density obtainable thereby is low. Further, even when the burning atmosphere is modified, the changeable range of the electric resistance is relatively small and accordingly the changeable rate of the gradation is small, whereby the image quality can not optionally be controlled.

Under these circumstances, it is the primary object of the present invention to provide a ferrite carrier powder composition having a wider changeable range of the electric resistance than that of the conventional ferrite composition.

The present invention provides a magnetic carrier powder composed essentially of particles of a ferrite having a composition represented by the formula $$(MO)_{100-x}(Fe_2O_3)_x \quad [I]$$

where M is Mg, Mn, Zn, Ni, a combination of Mg in an atomic ratio of at least 0.05 with at least one metal selected from the group consisting of Zn, Cu, Mn and Co, a combination of Mn in an atomic ratio of at least 0.05 with at least one metal selected from the group consisting of Zn, Cu, Mg and Co, or a combination of Ni in an atomic ratio of at least 0.05 with at least one metal selected from the group consisting of Zn, Mg, Mn, Cu and Co, and x is greater than 53 molar %.

Now, the present invention will be described in detail with reference to the preferred embodiments.

In the first embodiment of the present invention, M in the formula I is Mg or a combination of Mg in an atomic ratio of at least 0.05 with at least one metal selected from the group consisting of Zn, Cu, Mn and Co.

In the second embodiment, M in the formula I is Mn, Zn or a combination of Mn in an atomic ratio of at least 0.05 with at least one metal selected from the group consisting of Zn, Cu, Mg and Co provided that Mg is in an atomic ratio of less than 0.05.

According to the third embodiment, M in the formula I is Ni or a combination of Ni in an atomic ratio of at least 0.05 with at least one metal selected from the group consisting of Zn, Mg, Mn, Cu and Co, and x in the formula I is at least 54 molar %.

Referring to the first and second embodiments, the amount x of iron as $Fe_2O_3$ is greater than 53 molar %. If x is less than 53 molar %, the changeable range of the electric resistance tends to be small. Whereas, especially when x is at least 54 mol %, the changeable range of the electric resistance becomes extremely wide. The upper limit for x is not critical and may be at any level less than 100 molar %. However, in view of the saturation magnetization, x is preferably at most 99 molar %, more preferably at most 90 molar %, whereby the saturation magnetization becomes extremely great and there will be little possibilities that the carrier deposits on the photosensitive material or the carrier scatters from the magnetic brush.

On the other hand, in the third embodiment as mentioned above, x is at least 54 molar %. If x is less than 54 molar %, the changeable range of the electric resistance tends to be small. Whereas, especially when x is at least 55 molar %, the changeable range of the electric resistance becomes extremely wide. As in the case of the first and second embodiments, the upper limit for x is not critical in the third embodiment and may be at any level less than 100 molar %. Likewise, x is preferably at most 99 molar %, more preferably at most 90 molar %, whereby the saturation magnetization becomes extremely great and there will be little possibilities that the carrier deposits on the photosensitive material or the carrier scatters from the magnetic brush.

With respect to M in the formula I, in the first embodiment, M may be composed of Mg alone or a combination of Mg with at least one of Zn, Cu, Mn and Co. When M is such a combination, the atomic ratio of Mg in M is at least 0.05. If the atomic ratio of Mg is less than 0.05, the saturation magnetization tends to decrease and the deposition of the carrier on the photosensitive material or the scattering of the carrier from the magnetic brush tends to increase. Likewise, in the second embodiment, M may be composed of Mn or Zn alone or a combination of Mn with at least one of Zn, Cu, Mg and Co. When M is composed of such a combination, the atomic ratio of Mn in M is at least 0.05. If the atomic ratio of Mn is less than 0.05, the saturation magnetization tends to decrease and the deposition of carrier or the scattering of the carrier as mentioned above tends to increase. Likewise, in the third embodiment, M may be composed of Ni alone or a combination of Ni with at least of one of Zn, Mg, Mn, Cu and Co. When M is composed of such a combination, the atomic ratio of Ni in M is at least 0.05. If the atomic ratio of Ni is less than 0.05, the saturation magnetization tends to decrease and the deposition of the carrier or the scattering of the carrier as mentioned above tends to increase.

In a preferred specific example of the first embodiment, MO in the formula I is represented by the formula $$(MgO)_y(XO)_{1-y} \quad [II]$$

In the formula II, X is Zn or a combination of Zn with at least one of Cu, Mn and Co, and y is at least 0.05 and less than 1. The ferrite powder having a composition represented by the above formula II gives extremely high saturation magnetization. In this case, better results are obtainable when y is from 0.05 to 0.99, especially from 0.1 to 0.7. The atomic ratio of Zn in X is preferably 1 or within a range of at least 0.3 and less than 1, whereby extremely high saturation magnetization is obtainable. When X is a combination of Zn with 2 or 3 elements selected from Cu, Mn and Co, the proportion of Cu, Mn or Co may be optionally selected.

Likewise, in a preferred example of the second embodiment, MO in the formula I is represented by the formula $$(MnO)_y(YO)_{1-y} \quad [III]$$

In the formula III, Y is Zn or a combination of Zn with at least one of Cu, Mg and Co, and y is at least 0.05 and less than 1. The composition represented by the formula III gives extremely high saturation magnetization. In this case, particularly good results are obtainable when y is from 0.05 to 0.99, especially from 0.1 to 0.7. The atomic ratio of Zn in Y is preferably 1 or within the range of at least 0.3 and less than 1, whereby an extremely high saturation magnetization is obtainable. Further, when Y is a combination of Zn with 2 or 3 elements selected from Cu, Mg and Co, the proportion of Cu, Mg or Co may be optionally selected.

Likewise, in a preferred example of the third embodiment, MO in the formula I is represented by the formula $$(NiO)_y(ZO)_{1-y} \quad [IV]$$

In the formula IV, Z is Zn or a combination of Zn with at least one of the Mg, Mn, Cu and Co and y is at least 0.05 and less than 1. The composition represented by the formula IV gives extremely high saturation magnetization. In this case, particularly good results are obtainable when y in the formula IV is from 0.05 to 0.99, especially from 0.1 to 0.7. The atomic ratio of Zn in Z is preferably 1 or within a range of at least 0.3 and less than 1, whereby an extremely high saturation magnetization is obtainable. When Z is a combination of Zn with 2 or 3 elements selected from Mg, Cu, Mn and Co, the proportion of Mg, Cu, Mn or Co may be optionally selected.

The ferrite powder particles of the present invention have a spinel structure. The ferrite powder particles having the above mentioned compositions may usually contain up to 5 molar % of an oxide of Ca, Bi, Cr, Ta, Mo, Si, V, B, Pb, K, Na or Ba. The ferrite powder particles usually have an average particle size of at most 1000 $\mu$m.

The ferrite powder particles are useful as a magnetic carrier powder as they are prepared i.e. without being coated with a coating layer on the surfaces.

The electric resistance of the ferrite powder particles constituting the magnetic carrier powder of the present invention is usually within a range of from $10^4$ to $10^4\Omega$, preferably from $10^5$ to $10^{12}\Omega$ as measured by the application of 100 V. With the ferrite powder particles of the present invention having an electric resistance within the above-mentioned range, the resistance value can continuously be changed by modifying the burning conditions which will be described hereinafter, and the maximum changeable ratio is as high as from $10^6$ to $10^{10}$, whereby an electrostatic image having a desired image quality can optionally be selected.

The measurement of the resistance of the ferrite powder particles can be conducted in the following manner in accordance with a magnetic brush development system. Namely, an N-pole and a S-pole are arranged to face each other with a magnetic pole distance of 8 mm so that the surface magnetic flux density of the magnetic poles becomes 1500 Gauss and the surface area of the facing magnetic poles is 10×30 mm. Between the magnetic poles, a pair of non-magnetic flat electrodes are disposed in parallel to each other with an electrode distance of 8 mm. Between the electrodes, 200 mg of a test sample is placed and the sample is held between the electrodes by the magnetic force. With this arrangement, the electric resistance is measured by an insulating resistance tester or an ampere meter.

If the resistance measures in such a manner exceeds $10^{14}\Omega$, the image density tends to decrease. On the other hand, if the resistance is less than $10^4\Omega$, the amount of the deposition of the carrier on the photosensitive material tends to increase and the resolving power and the gradation tend to be deteriorated, whereby the image quality tends to be of high contrast.

Further, the saturation magnetization $\sigma_m$ of the ferrite powder particles of the present invention is preferably at least 35 emu/g, whereby the deposition of the carrier on the photosensitive material or the scattering of the carrier by repeated development operations can be minimized. Better results are obtainable when the saturation magnetization $\sigma_m$ is at least 40 emu/g.

The magnetic carrier powder composed of such ferrite powder particles may be prepared in such a manner as described in U.S. Pat. Nos. 3,839,029, 3,914,181 or 3,926,657. Namely, firstly, metal oxides are mixed. Then, a solvent such as water is added and the mixture is slurried, for instance, by means of a ball mill. Additives such as a dispersing agent or a binder may be added as the case requires. The slurry is then granulated and dried by a spray drier. Thereafter, the granules are subjected to burning at a predetermineed burning temperature in a predetermined burning atmosphere. The burning may be conducted in accordance with a conventional method.

If the equilibrium oxygen partial pressure at the time of the burning is reduced, the electric resistance of the ferrite powder particles decreases. If the oxygen partial pressure is continuously changed from the burning atmosphere of air to the burning atmosphere of the nitrogen, the electric resistance of the particles can likewise continuously be changed.

After the burning, the particles are pulverized or dispersed and classified into a desired particle size to obtain a magnetic carrier powder of the present invention.

The magnetic carrier powder of the present invention is mixed with a toner to obtain a developer. The type of the toner to be used and the toner concentration are not critical and may optionally be selected.

Further, the magnetic brush development system to be used to obtain an electrostatic copy image and the photosensitive material are not critical, and an electrostatic copy image can be obtained in accordance with a conventional magnetic brush development method.

By optionally modifying the burning atmosphere in its production, the magnetic carrier powder of the present invention can be prepared to have a wide changeable range of the electric resistance i.e. as wide as from $10^6$ to $10^{10}$. Therefore, it is possible to readily obtain a carrier powder which is capable of providing an optimum image depending upon the type of the copying machine. Further, the image quality can thereby optionally be selected.

The magnetic carrier powder of the present invention is not required to have a coating on the particle surfaces and accordingly its durability is excellent.

Furthermore, the saturation magnetization thereby obtained is as high as at least 35 emu/g, whereby the deposition of the carrier on the photosensitive material or the scattering of the carrier can be minimized.

Now, the present invention will be described in further detail with reference to Examples.

EXAMPLE 1

Metal oxides were mixed to obtain six different types of compositions (Samples Nos. 1 to 6) as shown in Table 1 in molar ratios calculated as the divalent metal oxides and $Fe_2O_3$. Then, one part by weight of water was added to one part by weight of each composition and the mixture was mixed for five hours in a ball mill to obtain a slurry. Appropriate amounts of a dispersing agent and a binder were added thereto. The slurry was then granulated and dried at a temperature of at least 150° C. by a spray drier. The granulated product was burned in a nitrogen atmosphere containing oxygen and a nitrogen atmosphere, respectively, at a maximum temperature of 1350° C. Thereafter, the granules were pulverized and classified to obtain twelve kinds of ferrite powder particles having an average particle size of 45 μm.

Each ferrite powder thereby obtained was subjected to an X-ray analysis and a quantative chemical analysis whereby it was confirmed that each ferrite powder had a spinel structure and a metal composition corresponding to the initial mixing ratio.

Then, the saturation magnetization $\sigma_m$ (emu/g) of each ferrite powder and its electrical resistance (Ω) upon application of 100 V were measured. The saturation magnetization $\sigma_m$ was measured by a magnetometer of a sample vibration type. The measurement of the electric resistance was conducted in the above-mentioned manner wherein the resistance of the 200 mg of the sample when 100 V was applied was measured by an insulation resistance meter. For each composition, $(\sigma_m)_N$ for the burning in the nitrogen atmosphere, $(\sigma_m)_A$ for the burning in the nitrogen atmosphere containing oxygen, the resistance $R_A$ for the burning in the nitrogen atmosphere containing oxygen, the resistance $R_N$ for the burning in the nitrogen atmosphere and the resistance changing ratio $R_A/R_N$ are shown in Table 1.

Further, each ferrite powder was by itself used as a magnetic carrier powder. Namely, it was mixed with a commercially available two-component toner (an average particle size of 11.5±1.5 μm) to obtain a developer having a toner concentration of 11.5% by weight. With use of each developer, magnetic brush development was carried out by mean of a commercially available electrostatic copying machine. The surface magnetic flux density of the magnet roller for the magnetic brush development was 1000 Gauss and the rotational speed of the magnet roller was 90 rpm. The distance between magnet roller and the photosensitive material was 4.0±0.3 mm. As the photosensitive material, a selenium photosensitive material was used and the maximum surface potential thereof was 800 V. With use of a Grey scale made by Eastman Kodak Co., a toner image was obtained on an ordinary paper sheet by means of the above-mentioned electrostatic copying machine. The image density (ID) with the original density (OD) being 1.0 was obtained, and the difference between $(ID)_N$ of the particles obtained by the burning in the nitrogen atmosphere and $(ID)_A$ of the particles obtained by the burning in the air atmosphere was obtained.

The results thereby obtained are shown in Table 1.

In almost all cases of the magnetic carrier powders, the deposition of the carrier on the photosensitive material or scattering of the carrier was scarecely observed.

TABLE 1

| | Present invention | | | | Comparative Samples | |
|---|---|---|---|---|---|---|
| Sample No. | 1 | 2 | 3 | 4 | 5 | 6 |
| Composition (molar %) | | | | | | |
| MgO | 6 | 10.5 | 14.5 | 18.5 | 19.5 | 23 |
| ZnO | 10 | 20 | 20 | 20 | 20 | 20 |
| CuO | 4 | 7.5 | 7.5 | 7.5 | 7.5 | 7.5 |
| $Fe_2O_3$ | 80 | 62 | 58 | 54 | 53 | 49.5 |
| Saturation magnetization (emu/g) | | | | | | |
| $(\sigma_m)_N$ | 95 | 85 | 85 | 70 | 70 | 46 |
| $(\sigma_m)_A$ | 65 | 62 | 55 | 50 | 50 | 46 |
| Electric resistance (Ω) | | | | | | |
| $R_N$ | $10^4$ | $10^5$ | $10^6$ | $10^8$ | $10^9$ | $10^{10}$ |
| $R_A$ | $10^{12}$ | $10^{12}$ | $10^{12}$ | $10^{12}$ | $10^{12}$ | $10^{12}$ |
| $R_A/R_N$ | $10^8$ | $10^7$ | $10^6$ | $10^4$ | $10^3$ | $10^2$ |
| $(ID)_N$-$(ID)_A$ | 1.0 | 1.0 | 0.9 | 0.7 | 0.3 | 0.2 |

From the results shown in Table 1, it is evident that the magnetic carrier powders of the present invention with a $Fe_2O_3$ content x of greater than 53 molar % have extremely great changing ratios of the resistance, whereby the gradation of the image can be modified to a great extent and the range of the free choice of the image quality is extremely wide.

Further, in the above Example, a mixture of oxygen and nitrogen was used as a burning atmosphere and the mixing ratio was varied, whereby it was confirmed that the resistance and the image density varies continuously between the values presented above.

EXAMPLE 2

In the same manner as in the Example 1, magnetic carrier powders were prepared to have the compositions as shown in Tables 2 and 3 and the above-mentioned $R_A$, $R_N$, $R_A/R_N$ and $(ID)_N-(ID)_A$ were measured.

The results are shown in Tables 2 and 3.

TABLE 2

| Sample No. | Composition (molar %) | | $R_A$ (Ω) | $R_N$ (Ω) | $R_A/R_N$ | $(ID)_N$-$(ID)_A$ |
|---|---|---|---|---|---|---|
| 7 (Comparative) | $[(MgO)_{0.04}(ZnO)_{0.96}]_{50.5}(Fe_2O_3)_{49.5}$ | $\sigma_m$ <20 emu/g | $10^{12}$ | $10^{10}$ | $10^2$ | 0.2 |
| 8 (Comparative) | $[(MgO)_{0.04}(ZnO)_{0.96}]_{47}(Fe_2O_3)_{53}$ | | $10^{12}$ | $10^7$ | $10^5$ | 0.7 |
| 8' (Comparative) | $(MgO)_{31.5}(ZnO)_{19}(Fe_2O_3)_{49.5}$ | | $10^{13}$ | $10^{10}$ | $10^3$ | 0.3 |
| 9 (Present invention) | $(MgO)_{25}(ZnO)_{15}(Fe_2O_3)_{60}$ | | $10^{13}$ | $10^6$ | $10^7$ | 0.9 |

TABLE 2-continued

| Sample No. | Composition (molar %) | $R_A$ (Ω) | $R_N$ (Ω) | $R_A/R_N$ | $(ID)_N-(ID)_A$ |
|---|---|---|---|---|---|
| 10 (Comparative) | $(MgO)_{10.5}(ZnO)_{20}(MnO)_{20}(Fe_2O_3)_{49.5}$ | $10^{12}$ | $10^9$ | $10^3$ | 0.3 |
| 11 (Present invention) | $(MgO)_{9.3}(ZnO)_{15.7}(MnO)_{20}(Fe_2O_3)_{55}$ | $10^{12}$ | $10^7$ | $10^5$ | 0.8 |
| 12 (Comparative) | $(MgO)_{25}(ZnO)_{25}(CoO)_1(Fe_2O_3)_{49}$ | $10^{13}$ | $10^{11}$ | $10^2$ | 0.2 |
| 13 (Present invention) | $(MgO)_{19.6}(ZnO)_{19.4}(CoO)_1(Fe_2O_3)_{60}$ | $10^{13}$ | $10^6$ | $10^7$ | 1.0 |
| 14 (Comparative) | $(MgO)_{25}(ZnO)_{20}(MnO)_{2.5}(CuO)_3(Fe_2O_3)_{49.5}$ | $10^{12}$ | $10^9$ | $10^3$ | 0.3 |
| 15 (Present invention) | $(MgO)_{18.8}(ZnO)_{13.7}(MnO)_{2.5}(CuO)_3(Fe_2O_3)_{62}$ | $10^{12}$ | $10^5$ | $10^7$ | 0.9 |

TABLE 3

| Sample No. | Composition (molar %) | $R_A$ (Ω) | $R_N$ (Ω) | $R_A/R_N$ | $(ID)_N-(ID)_A$ |
|---|---|---|---|---|---|
| 16 (Comparative) | $(MgO)_{20}(ZnO)_{20}(MnO)_5(CuO)_6(Fe_2O_3)_{49}$ | $10^{13}$ | $10^{11}$ | $10^2$ | 0.2 |
| 17 (Present invention) | $(MgO)_{10}(ZnO)_{20}(MnO)_{3.9}(CuO)_{6.1}(Fe_2O_3)_{60}$ | $10^{13}$ | $10^7$ | $10^6$ | 0.8 |
| 18 (Comparative) | $(MgO)_{10}(ZnO)_{20}(MnO)_{20}(CoO)_1(Fe_2O_3)_{49}$ | $10^{13}$ | $10^{11}$ | $10^2$ | 0.2 |
| 19 (Present invention) | $(MgO)_{3.9}(ZnO)_{15}(MnO)_{0.1}(CoO)_1(Fe_2O_3)_{80}$ | $10^{13}$ | $10^3$ | $10^{10}$ | 1.0 |
| 20 (Comparative) | $(MgO)_{10}(ZnO)_{20}(MnO)_{10}(CoO)_1(Fe_2O_3)_{49}$ | $10^{13}$ | $10^{10}$ | $10^3$ | 0.3 |
| 21 (Present invention) | $(MgO)_{8.8}(ZnO)_{20}(MnO)_{5.2}(CoO)_1(Fe_2O_3)_{55}$ | $10^{13}$ | $10^7$ | $10^6$ | 0.9 |
| 22 (Comparative) | $(MgO)_{20}(ZnO)_{23}(MnO)_2(CuO)_4(CoO)_1(Fe_2O_3)_{50}$ | $10^{12}$ | $10^9$ | $10^3$ | 0.3 |
| 23 (Present invention) | $(MgO)_{18}(ZnO)_{20}(MnO)_2(CuO)_4(CoO)_1(Fe_2O_3)_{55}$ | $10^{12}$ | $10^7$ | $10^5$ | 0.8 |

The superior qualities of the present invention are evident from the results shown in Tables 2 and 3.

With Samples Nos. 8' to 23, a $\sigma_m$ of at least 40 emu/g was obtained, whereby no substantial deposition of the carrier on the photosensitive material or no substantial scattering of the carrier was observed. Whereas, Samples Nos. 7 and 8 had a $\sigma_m$ of less than 20 emu/g and substantial deposition of the carrier and substantial scattering of the carrier were observed.

EXAMPLE 3

Samples Nos. 24 to 29 were prepared in the same manner as in Example 1 except that instead of the tunnel furnace, a rotary kiln was used for the burning. The physical properties of the samples were measured in the same manner in Example 1. The compositions of the samples and their physical properties are shown in Table 4. Further, most of the magnetic carrier powders did not deposit substantially on the photosensitive material and no substantial scattering of the carrier was observed. However, Samples Nos. 28 and 29 containing 53 molar % or less of $Fe_2O_3$ which were burned in nitrogen containing oxygen had 94 $_m$ of 40 emu/g or less, whereby the deposition of the carrier on the photosensitive material and the scattering of the carrier were observed.

TABLE 4

| | Present invention | | | | Comparative Samples | |
|---|---|---|---|---|---|---|
| Sample No. | 24 | 25 | 26 | 27 | 28 | 29 |
| Composition (molar %) | | | | | | |
| MnO | 15 | 28.5 | 31.5 | 34.5 | 35.2 | 39.9 |
| ZnO | 5 | 9.5 | 10.5 | 11.5 | 11.8 | 12.6 |
| $Fe_2O_3$ | 80 | 62 | 58 | 54 | 53 | 49.5 |
| $\sigma_m$ (emu/g) | 85 | 80 | 72 | 66 | 64 | 45 |

TABLE 4-continued

| | Present invention | | | | Comparative Samples | |
|---|---|---|---|---|---|---|
| Sample No. | 24 | 25 | 26 | 27 | 28 | 29 |
| $R_A$ (Ω) | $10^{12}$ | $10^{12}$ | $10^{12}$ | $10^{12}$ | $10^{12}$ | $10^{12}$ |
| $R_N$ (Ω) | $10^5$ | $10^5$ | $10^6$ | $10^7$ | $10^9$ | $10^9$ |
| $R_A/R_N$ | $10^7$ | $10^7$ | $10^6$ | $10^5$ | $10^3$ | $10^3$ |
| $(ID)_A-(ID)_N$ | 1.0 | 1.0 | 0.9 | 0.8 | 0.3 | 0.3 |

From the results shown in Table 4, it is evident that the magnetic carrier powders of the present invention containing more than 53 molar % of $Fe_2O_3$ have extremely great changing ratios of the resistances, whereby the gradation of the image can greatly be varied and the range for free choice of the image quality is extremely wide.

In the above Example, a mixture of nitrogen containing oxygen and nitrogen was used as the burning atmosphere and the mixing ratio was varied, whereby it was confirmed that the electric resistance and the image density were varied continuously between the values presented above.

EXAMPLE 4

In the same manner as in Example 1, magnetic carrier powders were prepared to have the compositions as shown in Table 5 and the above-mentioned $R_A$, $R_N$, $R_A/R_N$ and $(ID)_N-(ID)_A$ were measured. The results thereby obtained are shown in Table 5.

TABLE 5

| Sample No. | Composition (molar %) | $R_A$ (Ω) | $R_N$ (Ω) | $R_A/R_N$ | $(ID)_N-(ID)_A$ |
|---|---|---|---|---|---|
| 30 (Comparative) | $[(MnO)_{0.04}(ZnO)_{0.96}]_{50.5}(Fe_2O_3)_{49.5}$ | $10^{12}$ | $10^{10}$ | $10^2$ | 0.2 |
| 31 (Comparative) | $[(MnO)_{0.04}(ZnO)_{0.96}]_{47}(Fe_2O_3)_{53}$ | $10^{12}$ | $10^7$ | $10^5$ | 0.7 |
| 32 (Comparative) | $(MnO)_{23}(ZnO)_{20}(CuO)_8(Fe_2O_3)_{49}$ | $10^{13}$ | $10^{11}$ | $10^2$ | 0.2 |
| 33 (Present invention) | $(MnO)_{20.3}(ZnO)_{20}(CuO)_{4.7}(Fe_2O_3)_{55}$ | $10^{13}$ | $10^6$ | $10^7$ | 1.0 |
| 34 (Comparative) | $(MnO)_{24}(ZnO)_{20}(CuO)_7(MgO)_2(Fe_2O_3)_{47}$ | $10^{13}$ | $10^{11}$ | $10^2$ | 0.2 |
| 35 (Present invention) | $(MnO)_{18.8}(ZnO)_{14.2}(CuO)_7(MgO)_2(Fe_2O_3)_{58}$ | $10^{13}$ | $10^6$ | $10^7$ | 1.0 |
| 36 (Comparative) | $(MnO)_{20}(ZnO)_{25}(CuO)_5(CoO)_1(Fe_2O_3)_{49}$ | $10^{12}$ | $10^{10}$ | $10^2$ | 0.2 |
| 37 (Present invention) | $(MnO)_{14.9}(ZnO)_{17.1}(CuO)_5(CoO)_1(Fe_2O_3)_{62}$ | $10^{12}$ | $10^5$ | $10^7$ | 1.0 |
| 38 (Comparative) | $(MnO)_{25.5}(ZnO)_{25.5}(Fe_2O_3)_{49}$ | $10^{13}$ | $10^{11}$ | $10^2$ | 0.2 |
| 39 (Present invention) | $(MnO)_{10}(ZnO)_{10}(Fe_2O_3)_{80}$ | $10^{13}$ | $10^4$ | $10^9$ | 1.1 |

The effects of the present invention are evident from the results shown in Table 5.

Further, with Samples Nos. 32 to 39, a $\sigma_m$ of at least 40 emu/g was obtained, whereby no substantial deposition of the carrier on the photosensitive material or no substantial scattering of the carrier were observed.

Whereas, Samples Nos. 31 to 32 had a $\sigma_m$ of 20 emu/g or less, whereby substantial deposition of the carrier and substantial scattering of the carrier were observed.

EXAMPLE 5

Samples Nos. 40 to 44 were prepared in the same manner as in Example 1 except that the burning was conducted at the maximum temperature of 1300° C. The properties of the samples were measured in the same manner as in Example 1. The compositions of the samples and their properties are shown in Table 6.

Each magnetic carrier powder did not show substantial deposition on the photosensitive material and no substantial scattering of the carrier was observed.

TABLE 6

| | Present invention | | | Comparative Samples | |
|---|---|---|---|---|---|
| Sample No. | 40 | 41 | 42 | 43 | 44 |
| Composition (molar %) | | | | | |
| NiO | 6 | 10.5 | 17.5 | 19.5 | 23 |
| ZnO | 10 | 20 | 20 | 20 | 20 |
| CuO | 3 | 6.5 | 6.5 | 6.5 | 6.5 |
| MnO | — | — | — | — | — |
| $Fe_2O_3$ | 80 | 62 | 55 | 53 | 49.5 |
| $(\sigma_m)_N$ (emu/g) | 85 | 60 | 55 | 50 | 45 |
| $(\sigma_m)_A$ (emu/g) | 60 | 60 | 50 | 50 | 45 |
| $R_A$ (Ω) | $10^{12}$ | $10^{13}$ | $10^{14}$ | $10^{14}$ | $10^{14}$ |
| $R_N$ (Ω) | $10^4$ | $10^5$ | $10^6$ | $10^{11}$ | $10^{12}$ |
| $R_A/R_N$ | $10^8$ | $10^8$ | $10^8$ | $10^3$ | $10^2$ |
| $(ID)_A$-$(ID)_N$ | 1.0 | 1.0 | 1.0 | 0.3 | 0.2 |

From the results shown in Table 6, it is evident that the magnetic powders of the present invention containing more than 53 mole % of $Fe_2O_3$ have extremely great changing ratios $R_A/R_N$, whereby the gradation of the image can be greatly varied and the range for free choice of image quality is extremely wide.

Further, in the above Example, a mixture of oxygen and nitrogen was used as the burning atmosphere and the mixting ratio was varied, whereby it was confirmed that the electric resistance and the image density were varied continuously between the values presented above.

EXAMPLE 6

In the same manner as in Example 1, magnetic carrier powders were prepared to have the compositions as shown in Table 7 and the above mentioned $R_A$, $R_N$, $R_A/R_N$ and $(ID)_N-(ID)_A$ were measured. The results thereby obtained are shown in Table 7.

Further, with Samples Nos. 45, 46 and 49 to 58, a $\sigma_m$ of at least 40 emu/g was obtained, whereby no substantial deposition of the carrier of the photosensitive material or the scattering of the carrier was observed. Whereas, Samples Nos. 47 and 48 had a $\sigma_m$ of 20 emu/g and substantial deposition of the carrier on the photosensitive material and substantial scattering of the carrier were observed.

We claim:

1. A magnetic carrier powder comprising particles of a ferrite having a composition represented by the formula $$(MO)_{100-x}(Fe_2O_3)_x \quad \text{(I)}$$

where M is Mg, Mn, Zn, Ni, a combination of Mg in an atomic ratio of at least 0.05 with at least one metal selected from the group consisting of Zn, Cu, Mn and Co, a combination of Mn in an atomic ratio of at least 0.05 with at least one metal selected from the group consisting of Zn, Cu, Mg and Co, or a combination of Ni in an atomic ratio of at least 0.05 with at least one metal selected from the group consisting of Zn, Mg, Mn, Cu, and Co, and x is greater than 53 molar %, wherein each magnetic carrier powder composition within the formula is capable of exhibiting a changeable resistance of from $10^4$ to $10^{14}\Omega$ when 100 V is applied, and said ferrite particles are free of a resin coating.

2. The magnetic carrier powder according to claim 1 wherein M in the formula I is Mg or a combination of Mg in an atomic ratio of at least 0.05 with at least one metal selected from the group consisting of Zn, Cu, Mn and Co.

3. The magnetic carrier powder according to claim 1 wherein M in the formula I is Mn, Zn or a combination of Mn in an atomic ratio of at least 0.5 with at least one metal selected from the group consisting of Zn, Cu, Mg and Co provided that Mg is in an atomic ratio of less than 0.05.

4. The magnetic carrier powder according to claim 1 wherein M in the formula I is Ni or a combination of Ni in an atomic ratio of at least 0.05 with at least one metal selected from the group consisting of Zn, Mg, Mn, Cu and Co and x in the formula I is at least 54 molar %.

5. The magnetic carrier powder according to claim 1 wherein x in the formula I is at most 99 molar %.

6. The magnetic carrier powder according to claim 1 wherein x in the formula I is at most 90 molar %.

7. The magnetic carrier powder according to claim 2 wherein MO in the formula I is represented by the formula

TABLE 7

| Sample No. | Composition (molar %) | $R_A$ (Ω) | $R_N$ (Ω) | $R_A/R_N$ | $(ID)_N$-$(ID)_A$ |
|---|---|---|---|---|---|
| 45 (Comparative) | $(NiO)_{22.3}(ZnO)_{24.7}(Fe_2O_3)_{53}$ | $10^{13}$ | $10^8$ | $10^5$ | 0.3 |
| 46 (Present invention) | $(NiO)_{18}(ZnO)_{20}(Fe_2O_3)_{62}$ | $10^{13}$ | $10^5$ | $10^8$ | 1.1 |
| 47 (Comparative) | $[(NiO)_{0.04}(ZnO)_{0.96}]_{49}(Fe_2O_3)_{53}$ } $\sigma_m$ <20 emu/g | $10^{14}$ | $10^8$ | $10^6$ | 0.4 |
| 48 (Comparative) | $[(NiO)_{0.04}(ZnO)_{0.96}]_{38}(Fe_2O_3)_{62}$ | $10^{14}$ | $10^5$ | $10^9$ | 1.1 |
| 49 (Comparative) | $(NiO)_{20}(ZnO)_{20}(MgO)_{10}(Fe_2O_3)_{50}$ | $10^{14}$ | $10^{11}$ | $10^3$ | 0.3 |
| 50 (Present invention) | $(NiO)_{18}(ZnO)_{18}(MgO)_9(Fe_2O_3)_{55}$ | $10^{14}$ | $10^5$ | $10^9$ | 1.1 |
| 51 (Comparative) | $(NiO)_{15}(ZnO)_{15}(MgO)_5(MnO)_5(Fe_2O_3)_{50}$ | $10^{12}$ | $10^8$ | $10^4$ | 0.3 |
| 52 (Present invention) | $(NiO)_{12}(ZnO)_{20}(MgO)_4(MnO)_4(Fe_2O_3)_{60}$ | $10^{12}$ | $10^4$ | $10^8$ | 1.0 |
| 53 (Comparative) | $(NiO)_{25}(ZnO)_{20}(CuO)_5(Fe_2O_3)_{50}$ | $10^{12}$ | $10^9$ | $10^3$ | 0.3 |
| 54 (Present invention) | $(NiO)_{20}(ZnO)_{16}(CuO)_4(Fe_2O_3)_{60}$ | $10^{12}$ | $10^4$ | $10^8$ | 1.0 |
| 55 (Comparative) | $(NiO)_{25}(ZnO)_{20}(MnO)_2(CuO)_3(Fe_2O_3)_{50}$ | $10^{12}$ | $10^{10}$ | $10^2$ | 0.2 |
| 56 (Present invention) | $(NiO)_{20}(ZnO)_{16}(MnO)_{1.6}(CuO)_{2.4}(Fe_2O_3)_{60}$ | $10^{12}$ | $10^5$ | $10^7$ | 1.0 |
| 57 (Comparative) | $(NiO)_{20}(ZnO)_{20}(CuO)_2(MgO)_5(MnO)_2(CoO)_1(Fe_2O_3)_{50}$ | $10^{14}$ | $10^{11}$ | $10^3$ | 0.3 |
| 58 (Present invention) | $(NiO)_{18}(ZnO)_{18}(CuO)_{1.8}(MgO)_{4.5}(MnO)_{1.8}(CoO)_{0.9}(Fe_2O_3)_{55}$ | $10^{14}$ | $10^6$ | $10^8$ | 1.0 |

The effects of the present invention are evident from the results shown in Table 7.

$$(MgO)_y(XO)_{1-y} \quad (II)$$

where X is Zn or a combination of Zn in an atomic ratio of at least 0.3 with at least one metal selected from the group consisting of Cu, Mn and Co, and y is from 0.05 to 0.99.

8. The magnetic carrier powder according to claim 7 wherein y in the formula II is from 0.1 to 0.7.

9. The magnetic carrier powder according to claim 3 wherein MO in the formula I is represented by the formula $$(MnO)_y(YO)_{1-y} \quad (III)$$

where Y is Zn or a combination of Zn in an atomic ratio of at least 0.3 with at least one metal selected from the group consisting of Cu, Mg and Co and y is from 0.05 to 0.99.

10. The magnetic carrier powder according to claim 9 wherein y in the formula III is from 0.1 to 0.7.

11. The magnetic carrier powder according to claim 4 wherein MO in the formula I is represented by the formula $$(NiO)_y(ZO)_{1-y} \quad (IV)$$

where Z is Zn or a combination of Zn in an atomic ratio of at least 0.3 with at least one metal selected from the group consisting of Mg, Mn, Cu and Co, and y is from 0.05 to 0.99.

12. The magnetic carrier powder according to claim 11 wherein y in the formula IV is from 0.1 to 0.7.

13. The magnetic carrier powder according to claim 1 wherein the ferrite contains at most 5 molar % of an oxide of Ca, Bi, Cr, Ta, Mo, Si, V, B, Pb, K, Na or Ba.

14. The magnetic carrier powder according to claim 1 wherein the ferrite particles have an average particle size of at most 1000 $\mu$m.

15. The magnetic carrier powder according to claim 1 wherein the ferrite particles have an electric resistance of from $10^5$ to $10^{12}\Omega$ when 100 V is applied.

16. The magnetic carrier powder according to claim 1 wherein the ferrite particles have saturation magnetization $\sigma_m$ of at least 35 emu/g.

17. The magnetic carrier powder according to claim 1 wherein the ferrite particles have saturation magnetization $\sigma_m$ of at least 40 emu/g.

18. A magnetic carrier powder comprising particles of a ferrite having a composition represented by the formula (I)

$$(MO)_{100-x}(Fe_2O_3)_x \quad (I)$$

where M is Mg, Mn, Zn, Ni, a combination of Mg in an atomic ratio of at least 0.05 with at least one metal selected from the group consisting of Zu, Cu, Mn, and Co, a combination of Mn in an atomic ratio of at least 0.05 with at least one metal selected from the group consisting Zn, Cu, Mg, and Co, or a combination of Ni in an atomic ratio of at least 0.05 with at least one metal selected from the group consisting of Zn, Mg, Mn, Cu, and Co, and x is greater than 53 molar %, wherein each magnetic carrier powder composition within the formula is capable of exhibiting a changeable resistance of from $10^4$ to $10^{14}\Omega$ when 100 V is applied, wherein the resistance of each specific compound within the above formula (I) can be set within the range of $10^4$ to $10^{14}\Omega$ by variation of the oxidation of the magnetic carrier powder, and said magnetic carrier powder is free of a resin coating.

19. In an electrophotography process using magnetic brush development, the improvement wherein a magnetic carrier powder is used in a two component developer wherein said magnetic carrier powder particles are free of resin and comprise a ferrite having a composition represented by the formula (I)

$$(MO)_{100-x}(Fe_2O_3)_x \quad (I)$$

where M is Mg, Mn, Zn, Ni, a combination of Mg in an atomic ratio of at least 0.05 with at least one metal selected from the group consisting of Zn, Cu, Mn, and Co, a combination of Mn in an atomic ratio of at least 0.05 with at least one metal selected from the group consisting of Zn, Cu, Mg, and Co or a combination of Ni in an atomic ratio of at least 0.05 with at least one metal selected from the group consisting of Zn, Mg, Mn, Cu, and Co, and x is greater 53 molar %, wherein each magnetic carrier powder composition within the formula is capable of exhibitng a changeable resistance of from $10^4$ to $10^{14}\Omega$ when 100 V is applied.

* * * * *

UNITED STATES PATENT AND TRADEMARK OFFICE

CERTIFICATE OF CORRECTION

PATENT NO. : 4,485,162

DATED : November 27, 1984

INVENTOR(S) : Kenji Imamura et al.

It is certified that error appears in the above-identified patent and that said Letters Patent is hereby corrected as shown below:

On the title page, Item /54/ should read

-- /54/ MAGNETIC CARRIER POWDER HAVING A WIDE CHANGEABLE RANGE OF ELECTRIC RESISTANCE USEFUL FOR MAGNETIC BRUSH DEVELOPMENT --.

Signed and Sealed this

*Twelfth* Day of *March 1985*

[SEAL]

*Attest:*

DONALD J. QUIGG

*Attesting Officer* *Acting Commissioner of Patents and Trademarks*